US007442280B1

(12) United States Patent
Klemets et al.

(10) Patent No.: US 7,442,280 B1
(45) **Date of Patent: *Oct. 28, 2008**

(54) PROCESS FOR THE PRODUCTION OF PAPER

(75) Inventors: Bore Klemets, Hoviksnas (SE); Hans Hallstrom, Nacka (SE); Anna Asplund, Hilversum (NL); Rein Sikkar, Floda (SE)

(73) Assignee: Akzo Nobel NV, Arnhem (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/691,962

(22) Filed: Oct. 18, 2000

Related U.S. Application Data

(63) Continuation of application No. PCT/SE99/00677, filed on Apr. 26, 1999.

(60) Provisional application No. 60/083,253, filed on Apr. 27, 1998.

(30) Foreign Application Priority Data

Apr. 27, 1998 (EP) ..... 98850067

(51) Int. Cl.

| | |
|---|---|
| ***D21H 21/10*** | (2006.01) |
| ***D21H 23/08*** | (2006.01) |
| ***D21H 23/02*** | (2006.01) |
| ***D21H 17/29*** | (2006.01) |
| ***D21H 17/31*** | (2006.01) |
| ***D21H 17/45*** | (2006.01) |

(52) U.S. Cl. ..... 162/158; 162/168.2; 162/168.3; 162/181.6; 162/189

(58) Field of Classification Search ... 162/168.1–168.3, 162/164.1, 164.3, 189–191, 181.1, 181.6, 162/181.7, 181.8, 183, 158, 164.6, 175
See application file for complete search history.

(56) References Cited

U.S. PATENT DOCUMENTS

| | | | | |
|---|---|---|---|---|
| 3,562,103 | A * | 2/1971 | Moser et al. | 162/175 |
| 3,884,755 | A * | 5/1975 | Frost, III | 162/190 |
| 4,115,188 | A * | 9/1978 | O'Brien et al. | 162/190 |
| 4,388,150 | A | 6/1983 | Sunden et al. | 162/175 |
| 4,749,444 | A | 6/1988 | Lorz et al. | 162/168.3 |
| 4,753,710 | A | 6/1988 | Langley et al. | 162/164.3 |
| 4,840,705 | A * | 6/1989 | Ikeda et al. | 162/175 |
| 4,927,498 | A | 5/1990 | Rushmere | 162/168.3 |
| 4,929,655 | A * | 5/1990 | Takeda et al. | 524/458 |
| 4,954,220 | A | 9/1990 | Rushmere | 162/168.3 |
| 4,961,825 | A | 10/1990 | Andersson et al. | 162/175 |
| 4,980,025 | A | 12/1990 | Andersson et al. | 162/168.3 |
| 5,006,590 | A * | 4/1991 | Takeda et al. | 524/458 |
| 5,071,512 | A | 12/1991 | Bixler et al. | 162/175 |
| 5,098,520 | A | 3/1992 | Begala | 162/168.1 |
| 5,127,994 | A | 7/1992 | Johansson | 162/168.3 |
| 5,169,540 | A | 12/1992 | Fillipo et al. | 210/728 |
| 5,176,891 | A | 1/1993 | Rushmere | 423/328.1 |
| 5,185,062 | A | 2/1993 | Begala | 162/168.1 |
| 5,277,764 | A * | 1/1994 | Johansson et al. | 162/175 |
| 5,292,404 | A | 3/1994 | Hartan et al. | 162/164.6 |
| 5,368,833 | A | 11/1994 | Johansson et al. | 423/338 |
| 5,393,380 | A * | 2/1995 | Reed et al. | 162/168.2 |
| 5,447,604 | A | 9/1995 | Johansson et al. | 162/181.6 |
| 5,466,338 | A * | 11/1995 | Pearson | 162/168.2 |
| 5,470,435 | A | 11/1995 | Rushmere et al. | 162/181.6 |
| 5,514,249 | A * | 5/1996 | Cauley et al. | 162/164.1 |
| 5,543,014 | A | 8/1996 | Rushmere et al. | 162/181.6 |
| 5,571,494 | A | 11/1996 | Saastamoinen | 423/338 |
| 5,573,674 | A | 11/1996 | Lind et al. | 210/702 |
| 5,584,966 | A | 12/1996 | Moffet | 162/168.1 |
| 5,587,415 | A * | 12/1996 | Takeda | 524/458 |
| 5,595,629 | A * | 1/1997 | Begala | 162/158 |

(Continued)

FOREIGN PATENT DOCUMENTS

| | | |
|---|---|---|
| EP | 0 183 466 | 6/1986 |
| EP | 0 335 575 | 10/1989 |
| EP | 335575 A2 * | 10/1989 |

(Continued)

OTHER PUBLICATIONS

Gus, daniel B., "Closed Water Systems in Mills Using Secondary Fiber," TAPPI, vol. 61, No. 16, pp. 19-21.*

Jonsson, B. M., "Advanced Water Recycling System Required for New South African Mill," in Trends and Developments in papermaking, edited by John C. W. Evans, Miller and Freeman Publications, Inc. Chapter 15, pp. 60-64, 1986.*

Panchapakesan, B., "Clossure of Mill Whitewater Systems Reduces Water Use, Conserves Energy," in New Trends and Developments in Papermaking, edited by Kelly Fergusson, Miller Freeman.* Publications, Inc., pp 70-73, 1994.*

R. K. Iler and R. L. Dalton, *Degree of Hydration Of Particles Of Colliodal Silica In Aqueous Solution, J. Phys. Chem*, 60, (1956), 955-957.

A. Thorp et al., *Paper Machine Operations, Pulp and Paper Manufacture, The Joint Textbooks Committee of the Paper Industry, Atlanta*, Third Ed. vol. 7, pp. 598-599; XP002109772.

(Continued)

*Primary Examiner*—José A Fortuna
(74) *Attorney, Agent, or Firm*—Robert C. Morriss; Michelle J. Burke; Lainie E. Parker

(57) ABSTRACT

A process for the production of paper from a suspension containing cellulosic fibers, and optional fillers, which comprises adding to the suspension a drainage and retention aid comprising a cationic organic polymer, forming and dewatering the suspension on a wire, wherein the cationic organic polymer has an aromatic group and the suspension which is dewatered on the wire has a conductivity of at least 2.0 mS/cm. The invention further relates to a process for the production of paper from a suspension containing cellulosic fibers, and optional fillers, comprising adding to the suspension a drainage and retention aid comprising a cationic organic polymer having an aromatic group, forming and dewatering the suspension on a wire to obtain a wet web of paper and white water, recirculating the white water and optionally introducing fresh water to form a suspension containing cellulosic fibers, and optional fillers, to be dewatered, wherein the amount of fresh water introduced is less than 30 tons per ton of dry paper produced.

29 Claims, No Drawings

U.S. PATENT DOCUMENTS

| | | | | | |
|---|---|---|---|---|---|
| 5,603,805 | A | | 2/1997 | Andersson et al. | 162/168.3 |
| 5,607,552 | A | | 3/1997 | Andersson et al. | 162/181.6 |
| 5,688,482 | A | | 11/1997 | Saastamoinen | 423/335 |
| 5,707,493 | A | | 1/1998 | Saastamoinen | 162/164.1 |
| 5,708,071 | A | | 1/1998 | Takeda | 524/458 |
| 5,755,930 | A | * | 5/1998 | Satterfield et al. | 162/164.1 |
| 5,762,758 | A | * | 6/1998 | Hoffman | 162/190 |
| 5,783,041 | A | * | 7/1998 | Underwood | 162/164.1 |
| 5,840,158 | A | * | 11/1998 | Choo et al. | 162/164.3 |
| 5,858,174 | A | * | 1/1999 | Persson et al. | 162/164.1 |
| 5,891,304 | A | * | 4/1999 | Shing | 162/168.2 |
| 5,958,188 | A | * | 9/1999 | Heard et al. | 162/168.2 |
| 5,968,316 | A | * | 10/1999 | McLauglin et al. | 162/181.6 |
| 6,059,930 | A | * | 5/2000 | Wong Shing et al. | 162/168.2 |
| 6,071,380 | A | * | 6/2000 | Hoffman | 162/190 |
| 6,235,205 | B1 | | 5/2001 | Huang et al. | 210/723 |
| 6,303,002 | B1 | * | 10/2001 | Linhart et al. | 162/199 |
| 6,702,946 | B1 | | 3/2004 | Huang et al. | 210/723 |
| 6,918,995 | B2 | * | 7/2005 | Frolich et al. | 162/164.5 |
| 2002/0139502 | A1 | * | 10/2002 | Hallstrom et al. | 162/168.3 |
| 2004/0250972 | A1 | * | 12/2004 | Carr | 162/164.1 |
| 2005/0236126 | A1 | * | 10/2005 | Frolich et al. | 162/168.2 |
| 2006/0130991 | A1 | * | 6/2006 | Solhage et al. | 162/158 |

FOREIGN PATENT DOCUMENTS

| | | | | |
|---|---|---|---|---|
| EP | 0 525 751 | | | 2/1993 |
| EP | 0 735 186 | A2 | | 10/1996 |
| EP | 0 735 186 | A3 | | 10/1996 |
| EP | 707673 | B1 | * | 4/1998 |
| EP | 953680 | A1 | * | 11/1999 |
| EP | 0 877 120 | B1 | | 3/2000 |
| JP | 61-6396 | A | | 1/1986 |
| JP | 61-6398 | A | | 1/1986 |
| JP | 63-92800 | | | 4/1988 |
| JP | 2609186 | B2 | | 2/1997 |
| WO | WO95/02088 | | | 1/1995 |
| WO | WO95/02288 | | | 1/1995 |
| WO | WO97/18351 | | | 5/1997 |
| WO | WO98/06898 | | | 2/1998 |
| WO | WO 9955965 | A1 | * | 11/1999 |

OTHER PUBLICATIONS

George W. Sears, Jr., *Determination of Specific Surface Area of Colloidal Silica By Titration With Sodium Hydroxide*, 28 (1956), No. 12, pp. 1981-1983.

English language translation of Japanese Laid-Open No. 1999-61680; laid-open date Mar. 5, 1999.

"European Commission, COST E1, Paper recycling, An introduction to problems and their solutions," Edited by Blanco, M.A. et al., 1997, (D10), 5 pages.

"Paper 2, Influence of closed systems on chemical flocculation, Angeles Blanco, University of Madrid, Spain, Towards the closed system-threats and opportunities," Mar. 1, 1994, (D11), 24 pages.

English language translation of Japanese Laid-Open No. 2537038; laid-open date Apr. 23, 1988.

English language translation of Japanese Laid-Open No. 1993-33292; laid-open date Feb. 9, 1993.

English language translation of Japanese Laid-Open No. 1997-176989; laid-open date Jul. 8, 1997.

Blanco, A. et al., "Predicting the impact of closing the water system in paper mills," Appita 1996, pp. 435-442.

Barnett, D. J. et al., "Mill Closure Forces Focus on Fines Retention, Foam Control," Pulp & Paper 70 (1996)4, pp. 89-95.

English language version of pp. 667-670 of Kaufmann, M. et al., "Natürliches $CaCO_3$ in holzhaltigen Systemen," Wochenblatt für Papierfabrikation, 18 (1983).

English-language translation of Japanese Laid-Open No. 1986-6396; laid-open date Jan. 13, 1986.

English-language translation of Japanese Laid-Open No. 1986-6398; laid-open date Jan. 13, 1986.

English-language translation of Japanese Unexamined Patent Application Laid-Open No. 63-92800. Publication Date Apr. 1998.

* cited by examiner

PROCESS FOR THE PRODUCTION OF PAPER

The present application is a continuation of PCT SE99/00677 filed Apr. 26, 1999, which claims priority of EP98850067.4 filed Apr. 27, 1998 and U.S. Provisional Patent Application Ser. No. 60/083,253 filed Apr. 27, 1998.

This invention relates to papermaking and more specifically to a process for the production of paper in which a cationic organic polymer having an aromatic group is added to a papermaking stock. The process provides improved drainage and retention.

BACKGROUND OF THE INVENTION

In the papermaking art, an aqueous suspension containing cellulosic fibers, and optional fillers and additives, referred to as stock, is fed into a headbox which ejects the stock onto a forming wire. Water is drained from the stock through the forming wire so that a wet web of paper is formed on the wire, and the web is further dewatered and dried in the drying section of the paper machine. Water obtained by dewatering the stock, referred to as white water, which usually contains fine particles, e.g. fine fibers, fillers and additives, is normally recirculated in the papermaking process. Drainage and retention aids are conventionally introduced into the stock in order to facilitate drainage and increase adsorption of fine particles onto the cellulosic fibers so that they are retained with the fibers on the wire. Cationic organic polymers like cationic starch and cationic acrylamide-based polymers are widely used as drainage and retention aids. These polymers can be used alone but more frequently they are used in combination with other polymers and/or with anionic microparticulate materials such as, for example, anionic inorganic particles like colloidal silica, colloidal aluminium-modified silica and bentonite.

U.S. Pat. Nos. 4,980,025; 5,368,833; 5,603,805; 5,607,552; and 5,858,174; as well as International Patent Application WO 97/18351 disclose the use of cationic and amphoteric acrylamide-based polymers and anionic inorganic particles as stock additives in papermaking. These additives are among the most efficient drainage and retention aids now in use. Similar systems are disclosed in European Patent Application No. 805,234.

It has, however, been observed that the performance of drainage and retention aids comprising cationic organic polymers deteriorates when used in stocks with high levels of salt, i.e. high conductivity, and dissolved and colloidal substances. Higher dosages of cationic polymer are normally required in such stocks but usually the drainage and retention effect obtained is still not entirely satisfactory. These problems are noticeable in paper mills where white water is extensively recirculated with the introduction of only low amounts of fresh water into the process, thereby further increasing the accumulation of salts and colloidal materials in the white water and the stock to be dewatered.

SUMMARY OF THE INVENTION

According to the present invention it has been found that improved drainage and retention can be obtained in stocks containing high levels of salt (high conductivity) and colloidal materials and/or in papermaking processes with a high degree of white water closure when using a drainage and retention aid comprising a cationic organic polymer having an aromatic group. More specifically, the present invention relates to a process for the production of paper from a suspension containing cellulosic fibers, and optional fillers, which comprises adding to the suspension a drainage and retention aid comprising a cationic organic polymer, forming and dewatering the suspension on a wire, the process being characterised in that the cationic organic polymer has an aromatic group and the suspension being dewatered on the wire has a conductivity of at least 2.0 mS/cm.

The present invention also relates to a process as described in the pre-characterising clause above, the process being further characterised in that it comprises forming and dewatering the suspension on a wire to obtain a wet web containing cellulosic fibers, or paper, and white water, recirculating the white water and optionally introducing fresh water to form a suspension containing cellulosic fibers, and optional fillers, to be dewatered to form paper, wherein the cationic organic polymer has an aromatic group and the amount of fresh water introduced is less than 30 tons per ton of dry paper produced. The invention thus relates to a process as further defined in the claims.

DETAILED DESCRIPTION OF THE INVENTION

The present invention results in improved drainage and/or retention when using stocks having high contents of salt, and thus having high conductivity levels, and colloidal materials. The present invention also results in improved drainage and/or retention when applied to papermaking processes with extensive white water recirculation and limited fresh water supply and/or processes using fresh water having high salt contents, in particular salts of di- and multivalent cations like calcium. Hereby, the present invention makes it possible to increase the speed of the paper machine and to use lower dosages of additives to give a corresponding drainage and/or retention effect, thereby leading to an improved papermaking process and economic benefits.

The cationic organic polymer having an aromatic group according to this invention, herein also referred to as "main polymer", is capable of functioning as a drainage and retention aid (agent). The term "drainage and retention aid", as used herein, refers to one or more components (aids, agents, or additives) which, when being added to a stock, give better drainage and/or retention than is obtained when not adding the said one or more components. Accordingly, the main polymer provides improved drainage and/or retention, either when used alone or when used in conjunction with one or more additional stock additives.

The main polymer can be linear, branched or cross-linked, e.g. in the form of a microparticulate material. Preferably the main polymer is water-soluble or water-dispersable. The aromatic group of the main polymer can be present in the polymer backbone or, preferably, it can be a pendent group attached to or extending from the polymer backbone or be present in a pendent group that is attached to or extending from the polymer backbone (main chain). Suitable aromatic (aryl) groups include those comprising a phenyl group, optionally substituted, a phenylene group, optionally substituted, and a naphthyl group, optionally substituted, for example groups having the general formulae $—C_6H_5$, $—C_6H_4—$, $—C_6H_3—$, and $—C_6H_2—$, e.g. in the form of phenylene ($—C_6H_4—$), xylylene ($—CH_2—C_6H_4—CH_2—$), phenyl ($—C_6H_5$), benzyl ($—CH_2—C_6H_5$), phenethyl ($—CH_2CH_2—C_6H_5$), and substituted phenyl (for example $—C_6H_4—Y$, $—C_6H_3Y_2$, and $—C_6H_2Y_3$) where one or more substituents (Y) attached to the phenyl ring can be selected from hydroxyl, halides, e.g. chloride, nitro, and hydrocarbon groups having from 1 to 4 carbon atoms.

The main polymer can be selected from homopolymers and copolymers prepared from one or more monomers comprising at least one monomer having an aromatic group, suitably an ethylenically unsaturated monomer, and the main polymer is suitably a vinyl addition polymer. The term "vinyl addition polymer", as used herein, refers to a polymer prepared by addition polymerization of one or more vinyl monomers or ethylenically unsaturated monomers which include, for example, acrylamide-based and acrylate-based monomers. Suitable main polymers include cationic vinyl addition polymers obtained by polymerizing a cationic monomer or a monomer mixture comprising a cationic monomer represented by the general formula (I):

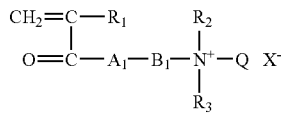

(I)

wherein $R_1$ is H or $CH_3$; $R_2$ and $R_3$ each H or, preferably, an alkyl group having from 1 to 3 carbon atoms, usually 1 to 2 carbon atoms; $A_1$ is O or NH; $B_1$ is an alkylene group having from 2 to 8 carbon atoms, suitably from 2 to 4 carbon atoms, or a hydroxy propylene group; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group (—$CH_2$—$C_6H_5$); and $X^-$ is an anionic counterion, usually a halide like chloride. Examples of suitable monomers represented by the general formula (I) include quaternary monomers obtained by treating dialkylaminoalkyl (meth) acrylates, e.g. dimethylaminoethyl (meth)acrylate, diethylaminoethyl (meth)acrylate and dimethylaminohydroxypropyl (meth)acrylate, and dialkylaminoalkyl (meth) acrylamides, e.g. dimethylaminoethyl (meth)acrylamide, diethylaminoethyl (meth)acrylamide, dimethylaminopropyl (meth)acrylamide, and diethylaminopropyl (meth)acrylamide, with benzyl chloride. Preferred cationic monomers of the general formula (I) include dimethylaminoethylacrylate benzyl chloride quaternary salt and dimethylaminoethylmethacrylate benzyl chloride quaternary salt.

The main polymer can be a homopolymer prepared from a cationic monomer having an aromatic group or a copolymer prepared from a monomer mixture comprising a cationic monomer having an aromatic group and one or more copolymerizable monomers. Suitable copolymerizable non-ionic monomers include monomers represented by the general formula (II):

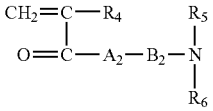

(II)

wherein $R_4$ is H or $CH_3$; $R_5$ and $R_6$ are each H or a hydrocarbon group, suitably alkyl, having from 1 to 6, suitably from 1 to 4 and usually from 1 to 2 carbon atoms; $A_2$ is O or NH; $B_2$ is an alkylene group of from 2 to 8 carbon atoms, suitably from 2 to 4 carbon atoms, or a hydroxy propylene group or, alternatively, A and B are both nothing whereby there is a single bond between C and N(O═C—$NR_5R_6$). Examples of suitable copolymerizable monomers of this type include (meth)acrylamide; acrylamide-based monomers like N-alkyl (meth)acrylamides and N,N-dialkyl (meth)acrylamides, e.g. N-n-propylacrylamide, N-isopropyl (meth)acrylamide, N-n-butyl (meth)acrylamide, N-isobutyl (meth)acrylamide and N-t-butyl (meth)acrylamide; and dialkylaminoalkyl (meth) acrylamides, e.g. dimethylaminoethyl (meth)acrylamide, diethylaminoethyl (meth)acrylamide, dimethylaminopropyl (meth)acrylamide and diethylaminopropyl (meth)acrylamide; acrylate-based monomers like dialkylaminoalkyl (meth)acrylates, e.g. dimethylaminoethyl (meth)acrylate, diethylaminoethyl (meth)acrylate, t-butyl-aminoethyl (meth) acrylate and dimethylaminohydroxypropyl acrylate; and vinylamides, e.g. N-vinylformamide and N-vinylacetamide. Preferred copolymerizable non-ionic monomers include acrylamide and methacrylamide, i.e. (meth)acrylamide, and the main polymer is preferably an acrylamide-based polymer.

Suitable copolymerizable cationic monomers include the monomers represented by the general formula (III):

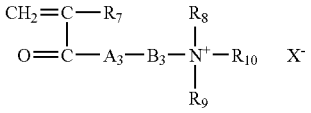

(III)

wherein $R_7$ is H or $CH_3$; $R_8$, $R_9$ and $R_{10}$ are each H or, preferably, a hydrocarbon group, suitably alkyl, having from 1 to 3 carbon atoms, usually 1 to 2 carbon atoms; $A_3$ is O or NH; $B_3$ is an alkylene group of from 2 to 4 carbon atoms, suitably from 2 to 4 carbon atoms, or a hydroxy propylene group, and $X^-$ is an anionic counterion, usually methylsulphate or a halide like chloride. Examples of suitable cationic copolymerizable monomers include acid addition salts and quaternary ammonium salts of the dialkylaminoalkyl (meth) acrylates and dialkylaminoalkyl (meth)acrylamides mentioned above, usually prepared using acids like HCl, $H_2SO_4$, etc., or quaternizing agents like methyl chloride, dimethyl sulphate, etc.; and diallyldimethylammonium chloride. Preferred copolymerizable cationic monomers include dimethylaminoethyl (meth)acrylate methyl chloride quaternary salt and diallyldimethylammonium chloride. Copolymerizable anionic monomers like acrylic acid, methacrylic acid, various sulfonated vinyl addition monomers, etc. can also be employed and, preferably, in minor amounts.

The main polymer according to this invention can be prepared from a monomer mixture generally comprising from 1 to 99 mole %, suitably from 2 to 50 mole % and preferably from 5 to 20 mole % of cationic monomer having an aromatic group, preferably represented by the general formula (I), and from 99 to 1 mole %, suitably from 98 to 50 mole %, and preferably from 95 to 80 mole % of other copolymerizable monomers which preferably comprises acrylamide or methacrylamide ((meth)acrylamide), the monomer mixture suitably comprising from 98 to 50 mole % and preferably from 95 to 80 mole % of (meth)acrylamide, the sum of percentages being 100.

The main polymer can also be selected from polymers prepared by condensation reaction of one or more monomers containing an aromatic group. Examples of such monomers include toluene diisocyanates, bisphenol A, phthalic acid, phthalic anhydride, etc., which can be used in the preparation of cationic polyurethanes, cationic polyamideamines, etc.

Alternatively, or additionally, the main polymer can be a polymer subjected to aromatic modification using an agent containing an aromatic group. Suitable modifying agents of this type include benzyl chloride, benzyl bromide, N-(3-chloro-2-hydroxypropyl)-N-benzyl-N,N-dimethylammonium chloride, and N-(3-chloro-2-hydroxypropyl) pyridinium chloride. Suitable polymers for such an aromatic modification include vinyl addition polymers. If the polymer contains a tertiary nitrogen which can be quaternized by the modifying agent, the use of such agents usually results in that the polymer is rendered cationic. Alternatively, the polymer to be subjected to aromatic modification can be cationic, for example a cationic vinyl addition polymer.

Usually the charge density of the main polymer is within the range of from 0.1 to 6.0 meqv/g of dry polymer, suitably from 0.2 to 4.0 and preferably from 0.5 to 3.0.

The weight average molecular weight of synthetic main polymers is usually at least about 500,000, suitably above about 1,000,000 and preferably above about 2,000,000. The upper limit is not critical; it can be about 50,000,000, usually 30,000,000 and suitably 25,000,000.

The main polymer of this invention may be in any state of aggregation such as, for example, in solid form, e.g. powders, in liquid form, e.g. solutions, emulsions, dispersions, including salt dispersions, etc. Examples of suitable main polymers for use in this invention include those described in U.S. Pat. Nos. 5,169,540; 5,708,071; and European Patent Applications 183,466; 525,751 and 805,234; the disclosures of which are hereby incorporated herein by reference. When being added to the stock, the main polymer is suitably in liquid form, e.g. in the form of an aqueous solution or dispersion.

The main polymer can be added into the stock to be dewatered in amounts which can vary within wide limits depending on, inter alia, type of stock, salt content, type of salts, filler content, type of filler, point of addition, etc. Generally the main polymer is added in an amount that gives better retention than is obtained when not adding it. The main polymer is usually added in an amount of at least 0.001%, often at least 0.005% by weight, based on dry stock substance, whereas the upper limit is usually 3% and suitably 1.5% by weight.

In a preferred embodiment of this invention, the main polymer is used in conjunction with an additional stock additive, thereby forming a drainage and retention aid comprising two or more components, usually referred to as drainage and retention aids. The term "drainage and retention aids", as used herein, refers to two or more components (aids, agents or additives) which, when being added to a stock, give better drainage and/or retention than is obtained when not adding the components. Examples of suitable stock additives of this type include anionic microparticulate materials, e.g. anionic organic particles and anionic inorganic particles, water-soluble anionic vinyl addition polymers, low molecular weight cationic organic polymers, aluminium compounds, and combinations thereof. In a preferred aspect of this embodiment, the main polymer is used in conjunction with an anionic microparticulate material, notably with anionic inorganic particles. In another preferred aspect of this embodiment, the main polymer is used in conjunction with anionic inorganic particles and a low molecular weight cationic organic polymer. In yet another preferred aspect of this embodiment, the main polymer is used in conjunction with anionic inorganic particles and an aluminium compound.

Anionic inorganic particles that can be used according to the invention include anionic silica-based particles and clays of the smectite type. It is preferred that the anionic inorganic particles are in the colloidal range of particle size. Anionic silica-based particles, i.e. particles based on $SiO_2$ or silicic acid, are preferably used and such particles are usually supplied in the form of aqueous colloidal dispersions, so-called sols. Examples of suitable silica-based particles include colloidal silica and different types of polysilicic acid. The silica-based sols can also be modified and contain other elements, e.g. aluminium and/or boron, which can be present in the aqueous phase and/or in the silica-based particles. Suitable silica-based particles of this type include colloidal aluminium-modified silica and aluminium silicates. Mixtures of such suitable silica-based particles can also be used. Drainage and retention aids comprising suitable anionic silica-based particles are disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Anionic silica-based particles suitably have an average particle size below about 50 nm, preferably below about 20 nm and more preferably in the range of from about 1 to about 10 nm. As conventional in silica chemistry, the particle size refers to the average size of the primary particles, which may be aggregated or non-aggregated. The specific surface area of the silica-based particles is suitably above 50 $m^2/g$ and preferably above 100 $m^2/g$. Generally, the specific surface area can be up to about 1700 $m^2/g$ and preferably up to 1000 $m^2/g$. The specific surface area can be measured by means of titration with NaOH in known manner, e.g. as described by Sears in Analytical Chemistry 28(1956):12, 1981–1983 and in U.S. Pat. No. 5,176,891. The given area thus represents the average specific surface area of the particles.

In a preferred embodiment of the invention, the anionic inorganic particles are silica-based particles having a specific surface area within the range of from 50 to 1000 $m^2$ μg, preferably from 100 to 950 $m^2$ μg. Sols of silica-based particles of these types also encompass modified sols like aluminium-containing silica-based sols and boron-containing silica-based sols. Preferably, the silica-based particles are present in a sol having an S-value in the range of from 8 to 45%, preferably from 10 to 30%, containing silica-based particles with a specific surface area in the range of from 300 to 1000 $m^2/g$, suitably from 500 to 950 $m^2$ μg, and preferably from 750 to 950 $m^2$ μg, which sols can be modified with aluminium and/or boron as mentioned above. For example, the particles can be surface-modified with aluminium to a degree of from 2 to 25% substitution of silicon atoms. The S-value can be measured and calculated as described by Iler & Dalton in J. Phys. Chem. 60(1956), 955–957. The S-value indicates the degree of aggregate or microgel formation and a lower S-value is indicative of a higher degree of aggregation.

In yet another preferred embodiment of the invention, the silica-based particles are selected from polysilicic acid and modified polysilicic acid having a high specific surface area, suitably above about 1000 $m^2/g$. The specific surface area can be within the range of from 1000 to 1700 $m^2/g$ and preferably from 1050 to 1600 $m^2/g$. The sols of modified polysilicic acid can contain other elements, e.g. aluminium and/or boron, which can be present in the aqueous phase and/or in the silica-based particles. In the art, polysilicic acid is also referred to as polymeric silicic acid, polysilicic acid microgel, polysilicate and polysilicate microgel, which are all encompassed by the term polysilicic acid used herein. Aluminium-containing compounds of this type are commonly also referred to as polyaluminosilicate and polyaluminosilicate microgel, which are both encompassed by the terms colloidal aluminium-modified silica and aluminium silicate used herein.

Clays of the smectite type that can be used in the process of the invention are known in the art and include naturally occurring, synthetic and chemically treated materials. Examples of suitable smectite clays include montmorillonite/bentonite, hectorite, beidelite, nontronite and saponite, preferably bentonite and especially such bentonite which after swelling preferably has a surface area of from 400 to 800 $m^2/g$ . Suitable clays are disclosed in U.S. Pat. Nos. 4,753,710; 5,071,512; and 5,607,552, which are hereby incorporated herein by reference.

Anionic organic particles that can be used according to the invention include highly cross-linked anionic vinyl addition polymers, suitably copolymers comprising an anionic monomer like acrylic acid, methacrylic acid and sulfonated or phosphonated vinyl addition monomers, usually copolymerized with nonionic monomers like (meth)acrylamide, alkyl (meth)acrylates, etc. Useful anionic organic particles also include anionic condensation polymers, e.g. melamine-sulfonic acid sols. Water-soluble anionic vinyl addition polymers that can be used according to the invention include copolymers comprising an anionic monomer like acrylic acid, methacrylic acid and sulfonated vinyl addition monomers, usually copolymerized with nonionic monomers like acrylamide, alkyl acrylates, etc., for example those disclosed in U.S. Pat. Nos. 5,098,520 and 5,185,062, the teachings of which are incorporated herein by reference.

Low molecular weight (hereinafter LMW) cationic organic polymers that can be used according to the invention include those commonly referred to and used as anionic trash catchers (ATC). ATC's are known in the art as neutralizing and/or fixing agents for detrimental anionic substances present in the stock and the use thereof in combination with drainage and/or retention aids often provides further improved drainage and/or retention. The LMW cationic organic polymer can be derived from natural or synthetic sources, and preferably it is an LMW synthetic polymer. Suitable organic polymers of this type include LMW highly charged cationic organic polymers such as polyamines, polyamidoamines, polyethyleneimines, homo- and copolymers based on diallyldimethyl ammonium chloride, (meth) acrylamides and (meth)acrylates. In relation to the molecular weight of the main polymer, the molecular weight of the LMW cationic organic polymer is preferably lower; it suitably has a weight average molecular weight of at least 2,000 and preferably at least 10,000. The upper limit of the molecular weight is usually about 700,000, suitably about 500,000 and usually about 200,000.

Aluminium compounds that can be used according to the invention include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions than chloride ions, for example anions from sulfuric acid, phosphoric acid, organic acids such as citric acid and oxalic acid.

Components of drainage and retention aids according to the invention can be added to the stock in conventional manner and in any order. When using drainage and retention aids comprising a main polymer and an anionic microparticulate material, notably anionic inorganic particles, it is preferred to add the main polymer to the stock before adding the microparticulate material, even if the opposite order of addition may be used. It is further preferred to add the main polymer before a shear stage, which can be selected from pumping, mixing, cleaning, etc., and to add the anionic particles after that shear stage. When using an LMW cationic organic polymer or an aluminium compound, such components are preferably introduced into the stock prior to introducing the main polymer, optionally used in conjunction with an anionic microparticulate material. Alternatively, the LMW cationic organic polymer and the main polymer can be introduced into stock essentially simultaneously, either separately or in admixture, for example as disclosed in U.S. Pat. No. 5,858,174, which is hereby incorporated herein by reference. The LMW cationic organic polymer and the main polymer are preferably introduced into the stock prior to introducing an anionic microparticulate material.

The drainage and retention aid(s) according to the invention can be added to the stock to be dewatered in amounts which can vary within wide limits depending on, inter alia, type and number of components, type of stock, salt content, type of salts, filler content, type of filler, point of addition, degree of white water closure, etc. Generally the aid(s) are added in amounts that give better drainage and/or retention than is obtained when not adding the components. The main polymer is usually added in an amount of at least 0.001%, often at least 0.005% by weight, based on dry stock substance, and the upper limit is usually 3% and suitably 1.5% by weight. Similar amounts are suitable for water-soluble anionic vinyl addition polymers, if used. When using an anionic microparticulate material in the process, the total amount added is usually at least 0.001% by weight, often at least 0.005% by weight, based on dry substance of the stock, and the upper limit is usually 1.0% and suitably 0.6% by weight. When using anionic silica-based particles, the total amount added is suitably within the range of from 0.005 to 0.5% by weight, calculated as $SiO_2$ and based on dry stock substance, preferably within the range of from 0.01 to 0.2% by weight. When using an LMW cationic organic polymer in the process, it can be added in an amount of at least 0.05%, based on dry substance of the stock to be dewatered. Suitably, the amount is in the range of from 0.07 to 0.5%, preferably in the range from 0.1 to 0.35%. When using an aluminium compound in the process, the total amount introduced into the stock to be dewatered depends on the type of aluminium compound used and on other effects desired from it. It is for instance well known in the art to utilize aluminium compounds as precipitants for rosin-based sizing agents. The total amount added is usually at least 0.05%, calculated as $Al_2O_3$ and based on dry stock substance. Suitably the amount is in the range of from 0.5 to 3.0%, preferably in the range from 0.1 to 2.0%.

The process of this invention is preferably used in the manufacture of paper from a suspension containing cellulosic fibers, and optional fillers, i.e. a stock, which has a high conductivity. Usually, the conductivity of the stock that is dewatered on the wire is at least 2.0 mS/cm, suitably at least 3.5 mS/cm, preferably at least 5.0 mS/cm and most preferably at least 7.5 mS/cm. Conductivity can be measured by standard equipment such as, for example, a WTW LF 539 instrument supplied by Christian Berner. The values referred to above are suitably determined by measuring the conductivity of the cellulosic suspension that is fed into or present in the headbox of the paper machine or, alternatively, by measuring the conductivity of white water obtained by dewatering the suspension.

High conductivity levels mean high contents of salts (electrolytes), where the various salts can be based on mono-, di- and multivalent cations like alkali metals, e.g. $Na^+$ and $K^+$, alkaline earths, e.g. $Ca^{2+}$ and $Mg^{2+}$, aluminium ions, e.g. $Al^{3+}$, $Al(OH)^{2+}$ and polyaluminium ions, and mono-, di- and multivalent anions like halides, e.g., $Cl^-$, sulfates, e.g. $SO_4^{2-}$ and $HSO_4^-$, carbonates, e.g. $CO_3^{2-}$ and $HCO_3^-$, silicates and lower organic acids. The invention is particularly useful in the manufacture of paper from stocks having high contents of salts of di- and multivalent cations, and usually the content of di- and multivalent cations is at least 200 ppm, suitably at least 300 pm and preferably at least 400 ppm. The salts can be derived from the stock preparation stage, i.e. from the materials used to form the stock, e.g. water, cellulosic fibers and fillers, in particular in integrated mills where a concentrated aqueous fiber suspension from the pulp mill normally is mixed with water to form a dilute suspension suitable for paper manufacture in the paper mill. The salt may also be derived from various additives introduced into the stock, from the fresh water supplied to the process, etc. Further, the content of salts is usually higher in processes where white water is extensively recirculated, which may lead to considerable accumulation of salts in the water circulating in the process.

The present invention further encompasses papermaking processes where white water is extensively recirculated (recycled), i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recirculation of white water obtained in the process suitably comprises mixing the white water with cellulosic fibers and/or optional fillers to form a suspension to be dewatered; preferably it comprises mixing the white water with a suspension containing cellulosic fibers, and optional fillers, before the suspension enters the forming wire for dewatering.

The white water can be mixed with the suspension before, between, simultaneous with or after introducing the components of drainage and retention aids, if used; and before, simultaneous with or after introducing the main polymer. Fresh water can be introduced in the process at any stage; for example, it can be mixed with cellulosic fibers in order to form a suspension, and it can be mixed with a suspension containing cellulosic fibers to dilute it so as to form the suspension to be dewatered, before, simultaneous with or after mixing the stock with white water and before, between, simultaneous with or after introducing the components of drainage and retention aids, if used; and before, simultaneous with or after introducing the main polymer.

Further additives which are conventional in papermaking can of course be used in combination with the additive(s) according to the invention, such as, for example, dry strength agents, wet strength agents, optical brightening agents, dyes, sizing agents like rosin-based sizing agents and cellulose-reactive sizing agents, e.g. ketene dimers and succinic anhydrides, etc. The cellulosic suspension, or stock, can also contain mineral fillers of conventional types such as, for example, kaolin, china clay, titanium dioxide, gypsum, talc and natural and synthetic calcium carbonates such as chalk, ground marble and precipitated calcium carbonate.

The process of this invention is used for the production of paper. The term "paper", as used herein, of course includes not only paper and the production thereof, but also other cellulosic fiber-containing sheet or web-like products, such as for example board and paperboard, and the production thereof. The process can be used in the production of paper from different types of suspensions of cellulose-containing fibers and the suspensions should suitably contain at least 25% by weight and preferably at least 50% by weight of such fibers, based on dry substance. The suspension can be based on fibers from chemical pulp such as sulphate, sulphite and organosolv pulps, mechanical pulp such as thermomechanical pulp, chemo-thermomechanical pulp, refiner pulp and groundwood pulp, from both hardwood and softwood, and can also be based on recycled fibers, optionally from de-inked pulps, and mixtures thereof.

The invention is further illustrated in the following Examples which, however, are not intended to limit the same. Parts and % relate to parts by weight and % by weight, respectively, unless otherwise stated.

EXAMPLE 1

(Comparison)

Drainage performance was evaluated by means of a Dynamic Drainage Analyser (DDA), available from Akribi, Sweden, which measures the time for draining a set volume of stock through a wire when removing a plug and applying vacuum to that side of the wire opposite to the side on which the stock is present.

The furnish used was based on 70% by weight of pulp of bleached birch/pine sulphate (60/40) refined to 200° CSF and 30% by weight of ground marble. Stock volume was 800 ml, consistency 0.3% and pH about 8.

Conductivity of the stock was adjusted to 0.47 mS/cm by addition of sodium sulphate. The stock was stirred in a baffled jar at a speed of 1500 rpm throughout the test and chemicals additions were conducted as follows: i) adding cationic polymer to the stock following by stirring for 30 seconds, ii) adding anionic inorganic particles to the stock followed by stirring for 15 seconds, iii) draining the stock while automatically recording the drainage time.

The polymers used in the test series were P1) a cationic copolymer prepared by polymerisation of acrylamide (90 mole%) and acryloxyethyldimethylbenzyl-ammonium chloride (10 mole %) and having a weight average molecular weight of about 6,000,000; and P2) a cationic copolymer prepared by polymerisation of acrylamide (90 mole %) and acryloxyethyltrimethylammonium chloride (10 mole %) and having a weight average molecular weight of about 6,000,000. The polymers P1 and P2 were dissolved in water and used as 0.1% aqueous solutions.

The anionic inorganic particles used were silica-based particles of the type disclosed in U.S. Pat. No. 5,368,833. The sol had an S-value of about 25% and contained silica particles with a specific surface area of about 900 $m^2/g$ which were surface-modified with aluminium to a degree of 5%. The silica-based particles were added in an amount of 1.0 kg/ton, calculated as $SiO_2$ and based on dry stock system.

Table 1 shows the drainage time at various dosages of P1 and P2, calculated as dry polymer on dry stock system.

TABLE 1

| Test | Polymer Dosage | $SiO_2$ Dosage | Conductivity | Dewatering time [s] | |
|---|---|---|---|---|---|
| o. | [kg/t] | [kg/t] | [mS/cm] | P1 | P2 |
| 1 | 0 | 0 | 0.47 | 18.4 | 18.4 |
| 2 | 1 | 1 | 0.47 | 12.5 | 10.6 |
| 3 | 1.5 | 1 | 0.47 | 6.9 | 5.6 |
| 4 | 2 | 1 | 0.47 | 4.9 | 4.3 |

EXAMPLE 2

(Comparison)

Dewatering and retention effect was evaluated by means of the DDA used in Example 1 in combination with a nephelometer. First pass retention was evaluated by measuring the turbidity of the filtrate, the white water, obtained by draining the stock.

The furnish used was based on 56% by weight of peroxide bleached TMP/SGW pulp (80/20), 14% by weight of bleached birch/pine sulphate pulp (60/40) refined to 2000 CSF and 30% by weight of china clay. To the stock was added 40 g/l of a colloidal fraction, bleach water from an SC mill, filtrated through a 5 μm screen and concentrated with an UF filter, cut off 200,000. Stock volume was 800 ml, consistency 0.14% and pH was adjusted to 4.0 using dilute sulphuric acid. The conductivity was adjusted by addition of calcium chloride (60 ppm $Ca^{2+}$), magnesium sulphate (18 ppm $Mg^{2+}$) and sodium bicarbonate (134 ppm $HCO_3^-$.

The polymers and anionic inorganic particles according to Example 1 were similarly used in this test series. Two dosages of polymers were used, 1 kg/t and 2 kg/t, respectively, calculated as dry polymer on dry stock system. Table 2 shows the dewatering and retention effect at various dosages of silica-based particles, calculated as $SiO_2$ and based on dry stock system.

TABLE 2

| Test | Polymer dosage | $SiO_2$ Dosage | Conductivity | Dewatering time [s] | | Turbidity [NTU] | |
|---|---|---|---|---|---|---|---|
| No. | [kg/t] | [kg/t] | [mS/cm] | P1 | P2 | P1 | P2 |
| 1 | 1 | 0 | 1.375 | 21.2 | 18.7 | 63 | 55 |
| 2 | 1 | 1 | 1.375 | 17.2 | 16.1 | 67 | 60 |
| 3 | 1 | 2 | 1.375 | 21.2 | 18.6 | 66 | 57 |
| 4 | 2 | 0 | 1.375 | 15.2 | 14.2 | 47 | 45 |
| 5 | 2 | 1 | 1.375 | 11 | 9.9 | 47 | 47 |
| 6 | 2 | 2 | 1.375 | 11.4 | 10.8 | 45 | 50 |

EXAMPLE 3

In this test series, the dewatering and retention effect was evaluated according to the procedure described in Example 2.

The furnish used was the same as used in Example 2. Stock volume was 800 ml and pH about 7. The conductivity was adjusted by addition of calcium chloride, thus simulating a very high electrolyte content and a high degree of white water closure.

The polymers and anionic inorganic particles according to Example 1 were similarly used in this test series.

Table 3 shows the dewatering and retention effect at various dosages of silica-based particles, calculated as $SiO_2$ and based on dry stock system.

TABLE 3

| Test | Polymer Dosage | $SiO_2$ Dosage | Conductivity | Dewatering time [s] | | Turbidity [NTU] | |
|---|---|---|---|---|---|---|---|
| No. | [kg/t] | [kg/t] | [mS/cm] | P1 | P2 | P1 | P2 |
| | | | 990 ppm $Ca^{2+}$ | | | | |
| 1 | 2 | 0 | 5.5 | 14.2 | 19.2 | 42 | 64 |
| 2 | 2 | 1 | 5.5 | 10.8 | 13.9 | 41 | 43 |
| 3 | 2 | 2 | 5.5 | 7.7 | 9.5 | 35 | 36 |
| 4 | 2 | 3 | 5.5 | 7.3 | 8.9 | 32 | 39 |
| | | | 1300 ppm $Ca^{2+}$ | | | | |
| 5 | 2 | 0 | 7.0 | 16.2 | 23.0 | 46 | 50 |
| 6 | 2 | 1 | 7.0 | 10.0 | 17.1 | 40 | 45 |
| 7 | 2 | 2 | 7.0 | 7.5 | 13.6 | 36 | 44 |
| 8 | 2 | 3 | 7.0 | 7.7 | 11.7 | 34 | 44 |
| | | | 1930 ppm $Ca^{2+}$ | | | | |
| 9 | 2 | 0 | 10.0 | 18.7 | 22.0 | 44 | 58 |
| 10 | 2 | 1 | 10.0 | 11.6 | 23.3 | 39 | 52 |
| 11 | 2 | 2 | 10.0 | 8.2 | 15.8 | 36 | 53 |
| 12 | 2 | 3 | 10.0 | 8.0 | 15.4 | 41 | 47 |

EXAMPLE 4

In this test series, the dewatering effect was evaluated with a "Canadian Standard Freeness Tester" which is the conventional method for characterising drainage according to SCAN-C 21:65. All additions of chemicals were made in a "Britt Dynamic Drainage Jar" with blocked outlet at a stirring speed of 1000 rpm during 45 seconds according to the procedure of Example 1 and the stock system was then transferred to the Freeness apparatus. Here the smallest hole in the bottom of the Freeness tester was blocked and the time for 400 ml of furnish to filtrate through the screen was measured. The stock was taken from a closed mill using waste paper. Consistency was 0.14%, conductivity 8.0 mS/cm and pH about 7. Table 4 shows the dewatering effect at various dosages of silica-based particles, calculated as $SiO_2$ and based on dry stock system.

TABLE 4

| Test | Polymer dosage | $SiO_2$ Dosage | Conductivity | Dewatering time [s] | |
|---|---|---|---|---|---|
| No. | [kg/t] | [kg/t] | [mS/cm] | P1 | P2 |
| 1 | 0.6 | 0 | 8.0 | 100.4 | 103.2 |
| 2 | 0.6 | 0.25 | 8.0 | 66.4 | 92.5 |
| 3 | 0.6 | 0.5 | 8.0 | 58.3 | 85.8 |
| 4 | 0.6 | 0.75 | 8.0 | 50.0 | 76.0 |
| 5 | 0.6 | 1 | 8.0 | 44.6 | 79.2 |

EXAMPLE 5

In this test series, the dewatering effect was evaluated as in Example 3, except that both sodium acetate (550 ppm $Na^+$) and calcium chloride (1300 ppm $Ca^{2+}$) was used to adjust the conductivity.

The polymers and anionic inorganic particles according to Example 1 were similarly used in this test series.

Table 5 shows the dewatering effect at various dosages of silica-based particles, calculated as $SiO_2$ and based on dry stock system.

TABLE 5

| Test | Polymer dosage | $SiO_2$ dosage | Conductivity | Dewatering time [s] | |
|---|---|---|---|---|---|
| No. | [kg/t] | [kg/t] | [mS/cm] | P1 | P2 |
| 1 | 2 | 1 | 2.5 | 16.1 | 18.2 |
| 2 | 1 | 3 | 10.0 | 10.7 | 14.7 |
| 3 | 2 | 3 | 10.0 | 6.8 | 13.5 |
| 4 | 3 | 3 | 10.0 | 5.3 | 14.0 |
| 5 | 2 | 1 | 10.0 | 9.7 | 20.4 |
| 6 | 2 | 2 | 10.0 | 7.9 | 14.8 |

EXAMPLE 6

In this test series, the dewatering and retention effect was evaluated as in Example 3, using a combination of sodium acetate (550 ppm $Na^+$) and calcium chloride (1300 ppm $Ca^{2+}$) to adjust the conductivity.

The polymers according to Example 1 were similarly used in this test series. The anionic microparticulate material used was a hydrated suspension of powdered Na-bentonite in water. The bentonite had a surface charge of about 0.33 meq/g and a swelling ability of 41 ml (2 g). The bentonite particles were added in an amount of 8.0 kg/ton, calculated as dry bentonite on dry stock system.

Table 6 shows the dewatering and retention effect at various dosages of P1 and P2, calculated as dry polymer on dry stock system.

TABLE 6

| Test | Polymer Dosage | Bentonote dosage | Conductivity | Dewatering time [s] | | Turbidity [NTU] | |
|---|---|---|---|---|---|---|---|
| No. | [kg/t] | [kg/t] | [mS/cm] | P1 | P2 | P1 | P2 |
| 1 | 1 | 8 | 10.0 | 13.6 | 18.5 | 41 | 47 |
| 2 | 2 | 8 | 10.0 | 10.8 | 20.6 | 29 | 41 |
| 3 | 3 | 8 | 10.0 | 8.48 | 24.8 | 20 | 36 |
| 4 | 4 | 8 | 10.0 | 7.42 | 26.6 | 18 | 36 |

EXAMPLE 7

In this test series, the dewatering effect was evaluated as in Example 6, except that sodium chloride was used to adjust the conductivity.

The polymers and bentonite according to Example 6 were similarly used in these tests. The bentonite particles were added in an amount of 8.0 kg/ton, calculated as dry bentonite on dry stock system. Table 7 shows the dewatering and retention effect at various dosages of P1 and P2, calculated as dry polymer on dry stock system.

TABLE 7

| Test | Polymer Dosage | Bentonite dosage | Conductivity | Dewatering time [s] | |
|---|---|---|---|---|---|
| No. | [kg/t] | [kg/t] | [mS/cm] | P1 | P2 |
| | | | 550 ppm $Na^+$ | | |
| 1 | 2 | 8 | 2.5 | 15.3 | 17.5 |
| 2 | 3 | 8 | 2.5 | 11.9 | 14.1 |
| 3 | 4 | 8 | 2.5 | 8.6 | 9.8 |
| 4 | 5 | 8 | 2.5 | 6.8 | 8.2 |
| | | | 3320 ppm $Na^+$ | | |
| 5 | 2 | 8 | 10.0 | 12.7 | 15.5 |
| 6 | 3 | 8 | 10.0 | 9.4 | 12.5 |
| 7 | 4 | 8 | 10.0 | 6.9 | 10.9 |
| 8 | 5 | 8 | 10.0 | 5.6 | 10.0 |

EXAMPLE 8

In this test series, the dewatering effect was evaluated as in Example 3, except that zinc chloride was used to adjust the conductivity. The polymers and anionic inorganic particles according to Example 1 were similarly used in these tests.

Table 8 shows the results of the dewatering tests at various dosages of silica-based particles, calculated as $SiO_2$ and based on dry stock system.

TABLE 8

| Test | Polymer Dosage | $SiO_2$ dosage | Conductivity | Dewatering time [s] | |
|---|---|---|---|---|---|
| No. | [kg/t] | [kg/t] | [mS/cm] | P1 | P2 |
| | | | 700 ppm $Zn^{2+}$ | | |
| 1 | 2 | 0 | 2.4 | 13.6 | 22.7 |
| 2 | 2 | 1 | 2.4 | 7.9 | 8.5 |
| 3 | 2 | 2 | 2.4 | 5.5 | 5.6 |

TABLE 8-continued

| Test | Polymer Dosage | $SiO_2$ dosage | Conductivity | Dewatering time [s] | |
|---|---|---|---|---|---|
| No. | [kg/t] | [kg/t] | [mS/cm] | P1 | P2 |
| | | | 1400 ppm $Zn^{2+}$ | | |
| 4 | 2 | 0 | 4.5 | 18.0 | 28.0 |
| 5 | 2 | 2 | 4.5 | 6.3 | 11.4 |

What is claimed is:

1. A process for the production of paper which comprises;

(i) providing a suspension containing cellulosic fibers, and optional fillers, (ii) adding to said suspension a drainage and retention aid comprising at least 0.001% by weight, based on dry stock substance, of anionic silica-based particles and at least 0.001% by weight, based on dry stock substance, of a cationic organic polymer which comprises in polymerized form a cationic monomer having an aromatic group represented by the general formula (I):

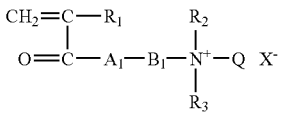

(I)

wherein $R_1$ is H or $CH_3$, $R_2$ and $R_3$ are each an alkyl group having from 1 to 3 carbon atoms, $A_1$ is O or NH, $B_1$ is an alkylene group of from 2 to 4 carbon atoms or a hydroxy propylene group, Q is benzyl, and $X^-$ is an anionic counterion, wherein the polymer is prepared from a monomer mixture consisting essentially of from 2 to 50 mole% cationic monomer having an aromatic group and from 98 to 50 mole% (meth)acrylamide; and (iii) forming and dewatering the obtained suspension on a wire, wherein the suspension that is dewatered on the wire has a conductivity between 2.4 and 10 mS/cm.

2. The process of claim 1, wherein the suspension that is dewatered on the wire has a conductivity of at least 5.0 mS/cm.

3. The process of claim 1, wherein the cationic organic polymer has a weight average molecular weight of at least 1,000,000.

4. The process of claim 1, wherein the cationic organic polymer is prepared from a monomer mixture comprising from 5 to 20 mole % of cationic monomer having an aromatic group and from 95 to 80 mole % of other copolymerizable monomers.

5. The process of claim 1, wherein the anionic silica-based particles are aluminium-modified silica-based particles.

6. The process of claim 1, wherein the drainage and retention aid further comprises a low molecular weight cationic organic polymer.

7. The process of claim 1, wherein the drainage and retention aid further comprises an aluminium compound.

8. The process of claim 1, wherein the suspension comprises recycled fibers.

9. The process of claim 1, wherein the suspension that is dewatered on the wire has a content of di- and multivalent cations of at least 300 ppm. further comprises a low molecular weight cationic organic polymer.

10. The process of claim 1 wherein the suspension that is dewatered on the wire has a conductivity of at least 7.5 mS/cm.

11. The process of claim 1 wherein the cationic monomer is dimethyl-aminoethylacrylate benzyl chloride quatemary salt or dimethylaminoethylmethacrylate benzyl chloride quatemary salt.

12. The process of claim 1 wherein the drainage and retention aid further comprises anionic organic particles.

13. The process of claim 12 wherein the anionic organic particles are cross-linked anionic vinyl addition polymers.

14. The process of claim 1 wherein the drainage and retention aid further comprises a water-soluble anionic vinyl addition polymer.

15. The process of claim 14 wherein the water-soluble anionic vinyl addition polymer is a copolymer comprising an anionic monomer which is acrylic acid, methacrylic acid or sulfonated vinyl addition monomer.

16. The process of claim 14 wherein the water-soluble anionic vinyl addition polymer is a copolymer comprising acrylamide.

17. The process of claim 1 wherein the anionic silica-based particles have a specific surface area above 100 $m^2/g$.

18. The process of claim 17, wherein the anionic silica-based particles are in the form of a silica sol having an S-value in the range of from 8 to 45% and a specific surface area of from 500 to 950 $m^2/g$.

19. The process of claim 1, wherein the monomer mixture consists of from 2 to 50 mole% cationic monomer having an aromatic group and from 98 to 50 mole% (meth)acrylamide.

20. A process for the production of paper which comprises;

(i) providing a suspension containing cellulosic fibres, and optional fillers, (ii) adding to said suspension a drainage and retention aids comprising a cationic organic polymer which comprises in polymerized form a cationic monomer having an aromatic group represented by the general formula (I):

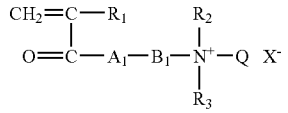

(I)

wherein $R_1$ is H or $CH_3$, $R_2$ and $R_3$ are each an alkyl group having from 1 to 3 carbon atoms, $A_1$ is O or NH, $B_1$ is an alkylene group of from 2 to 4 carbon atoms or a hydroxy propylene group, Q is benzyl, and $X^-$ is an anionic counterion, wherein the polymer is prepared from a monomer mixture consisting essentially of from 2 50 mole% cationic monomer having an aromatic group and from 98 to 50 mole% (meth)acrylamide; and anionic silica-based particles;

(iii) forming and dewatering the obtained suspension on a wire, wherein the suspension that is dewatered on the wire has a conductivity between 2.4 and 10 mS/cm and obtaining a wet web of paper and white water, recirculating white water and introducing fresh water to form a suspension containing cellulosic fibres, and optional fillers, to be dewatered, wherein the amount of fresh water introduced is less than 20 tons per ton of dry paper produced.

21. The process of claim 20, wherein the anionic inorganic particles are silica-based particles.

22. The process of claim 20 wherein the cationic monomer is dimethylaminoethylacrylate benzyl chloride quatemary salt or dimethylaminoethylmethacrylate benzyl chloride quatemary salt.

23. The process of claim 20, wherein the anionic silica-based particles are in the form of a silica sol having an S-value in the range of from 8 to 45% and a specific surface area of from 500 to 950 $m^2/g$.

24. The process of claim 20, wherein the monomer mixture consists of from 2 to 50 mole% cationic monomer having an aromatic group and from 98 to 50 mole% (meth)acrylamide.

25. A process for the production of paper which comprises;

(i) providing a suspension containing cellulosic fibers, and optional fillers, (ii) adding to said suspension drainage and retention aids comprising a cationic organic polymer which comprises in polymerized form a cationic monomer having an aromatic group represented by the general formula (I):

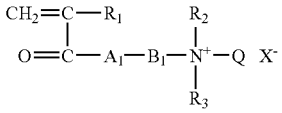

(I)

wherein $R_1$, is H or $CH_3$, $R_2$ and $R_3$a are each an alkyl group having from 1 to 3 carbon atoms, $A_1$ is O or NH, $B_1$ is an alkylene group of from 2 to 4 carbon atoms or a hydroxy propylene group, Q is benzyl, and $X^-$ is an anionic counterion, wherein the polymer is prepared from a monomer mixture consisting essentially of from 2 to 50 mole% cationic monomer having an aromatic group and from 98 to 50 mole% (meth)acrylamide; and anionic organic particles; and (iii) forming and dewatering the obtained suspension on a wire, wherein the suspension that is dewatered on the wire has a conductivity between 5.5 and 10 mS/cm.

26. The process of claim 25 wherein the anionic organic particles are cross-linked anionic vinyl addition polymers.

27. The process of claim 25 wherein the cationic organic polymer is an acrylamide-based polymer.

28. The process of claim 25 wherein the cationic monomer is dimethylaminoethylacrylate benzyl chloride quatemary salt or dimethylaminoethylmethacrylate benzyl chloride quatemary salt.

29. The process of claim 25, wherein the monomer mixture consists of from 2 to 50 mole% cationic monomer having an aromatic group and from 98 to 50 mole% (meth)acrylamide.

* * * * *